United States Patent [19]

Carr

[11] Patent Number: 4,470,884

[45] Date of Patent: Sep. 11, 1984

[54] HIGH SPEED ALUMINUM WIRE ANODIZING MACHINE AND PROCESS

[75] Inventor: Daniel Carr, North Muskegon, Mich.

[73] Assignee: National Ano-Wire, Inc., Muskegon, Mich.

[21] Appl. No.: 291,116

[22] Filed: Aug. 7, 1981

[51] Int. Cl.[3] ..... C25D 11/04

[52] U.S. Cl. ..... 204/28; 204/58; 204/206

[58] Field of Search ..... 204/28, 206–211, 204/58, 56 R

[56] References Cited

U.S. PATENT DOCUMENTS

| | | | |
|---|---|---|---|
| 1,058,047 | 4/1913 | Gibbs | 204/28 |
| 1,120,191 | 12/1914 | Gibbs | 204/238 X |
| 1,804,486 | 5/1931 | Wright | 204/210 |
| 3,046,214 | 7/1962 | Ross | 204/210 |
| 3,113,094 | 12/1963 | Seaward | 204/206 |
| 3,359,190 | 12/1967 | Cooke et al. | 204/28 |
| 3,432,407 | 3/1969 | Ricci | 204/28 |
| 3,629,077 | 12/1971 | Gannoe | 204/28 |
| 3,676,322 | 7/1972 | Kamata et al. | 204/206 |
| 3,827,951 | 8/1974 | Kallianides et al. | 204/28 |
| 3,919,069 | 11/1975 | Ascher | 204/206 |
| 3,959,090 | 5/1976 | Hölligl et al. | 204/28 |

*Primary Examiner*—G. L. Kaplan
*Assistant Examiner*—W. T. Leader
*Attorney, Agent, or Firm*—John A. Waters

[57] ABSTRACT

A high speed aluminum wire anodizing machine and process are provided which includes anodizing aluminum wire in an anodizer tank having wire ingress and egress openings. At least two adjacent rotatable wire accumulator drums are provided in the tank, preferably with means for producing a flow of anodizing electrolytes into each of the drums through an end hub thereof and out of the sidewalls of the drums passed circumferential wire separators. An anode is located proximal to the wire ingress opening, preferably in a contact cell which has an adjustable wire egress window. At least one cathode is provided in the tank. The cathode is preferably either between the drums or a pair of cathodes are provided above and below the drums adjacent to the sidwalls thereof, or both.

13 Claims, 7 Drawing Figures

HIGH SPEED ALUMINUM WIRE ANODIZING MACHINE AND PROCESS

BACKGROUND OF THE INVENTION

1. Field of the Invention

This invention relates to wire anodizing, and, more particularly, to a high speed aluminum wire anodzing machine and process.

2. Description of the Prior Art

In recent years, there has been a rapid increase in the commercial use of anodized aluminum wire, strip stock and the like. This is especially true in the electrical equipment industry as a substitute for increasingly expensive copper wire. In addition, the dielectric properties of the anodizing have been found to be preferred over other types of dielectric wire coatings.

In the anodizing of aluminum wire and the like, a protective oxide film is formed on the metal by passing an electric current through a bath or eletrolyte in which the metal is suspended and through which it passes. Although the general process of anodizing is well known and in commercial use, current methods are slow and problematical. For example, one of the most common means of anodizing aluminum wire and the like is to pass the wire through a very long anodizing tank. In order to achieve sufficient retention time of the the wire in the tank to yield the desired anodized coating, the wire is run very slowly through the tank at a speed on the order of 20 feet per minute. Because of the very slow speed of this process, the cost of anodized wire produced by this type of process is unduly high.

Although attempts have been made to speed up the process of anodizing aluminum wire and the like, the results have been unsatisfactory. For example, the anodizing resulting from these attempts at increasing the speed of the process have included cracking and flaking of the anodizing, poor adherence, and incomplete coverage and eratic coating thicknesses.

Accordingly, there is a current need for a high speed means to anodize alumunum wire which will produce uniform anodized coating with complete wire coverage.

SUMMARY OF THE INVENTION

According to the present invention, there is provided a high speed aluminum wire anodizing machine and process which will produce uniform anodizing coatings with complete wire coverage with significant cost savings. Wire speeds of on the order of 1,000 feet per minute and higher are achievable with the unique machine and process of the present invention.

The process of the present invention includes anodizing alumunum wire and the like in a unique anodizing machine which includes a wire anodizing tank which has wire ingress and egress openings. An anode is provided proximal to the wire ingress opening, preferably in a contact cell which has an adjustable wire window to permit wire to continuously pass from the contact cell to wire accumulator drums in the anodizer tank.

At least two adjacent rotatable wire accumulator drums are provided in the tank with the axes of rotation of the drums in parallel alignment. Preferably, the accumulator drums are generally hollow and include end hubs on each end of the drums. Each drum has plurality of circumferential wire separators on the outer periphery of the sidewall of the drum and means for producing a flow of anodizing electrolyte into each drum through at least one of the end hubs and out of the sidewall of the drums past the wire separators. The preferred flow producing means includes at least one radial slot in at least one end hub in each of the drums with an external angled radial pumping vane adjacent to the slot. The sidewall of each drum comprises a plurality of spaced slanted support bars extending between the hubs perpendicular thereto.

DESCRIPTION OF THE PREFERRED EMBODIMENTS

Figures 1, 6:
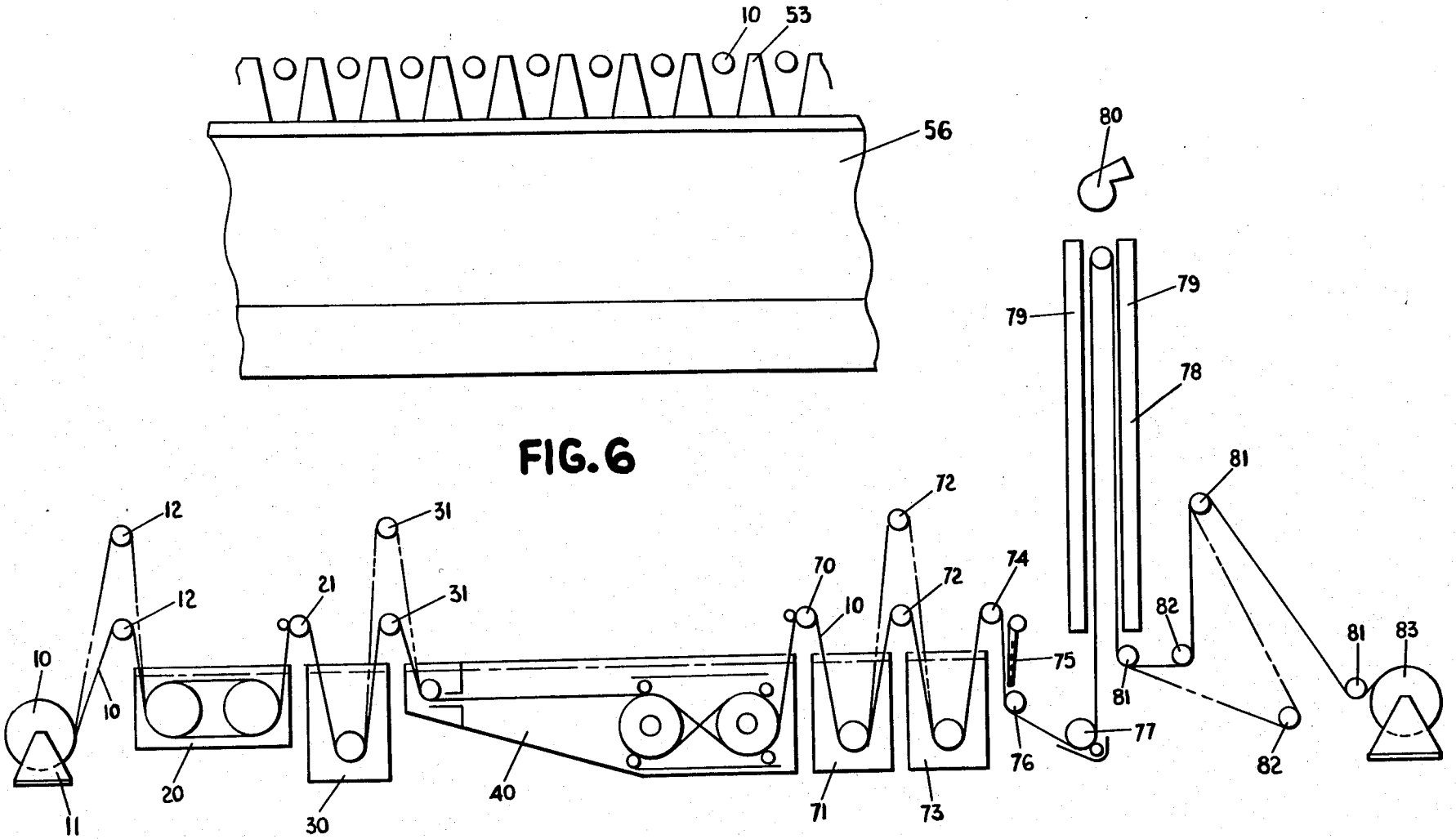
FIG. 1 is a schematic flow diagram of a complete wire anodizing process utilizing the unique high speed wire anodizing machine of the present invention.
FIG. 6 is a fragmentary cross-sectional view of the accumulator drum showing the wire separators.

FIG. 1 is a schematic flow diagram of a complete wire anodizing process utilizing the unique high speed wire anodizing machine of the present invention. Although the process and machine will be described in terms of anodizing aluminum wire, it should be understood that the process and machine are also useful for other forms of aluminum such as strip stock and for electroplating other types of wires, strip stock and the like. Accordingly, the discussion in terms of anodizing aluminum wire is not to be construed as limiting the scope of the process and machine of the present invention.

As shown in FIG. 1, a spool of aluminum wire 10 is rotatably mounted on unwiding stand 11. Wire 10 passes over a conventional tensioning take-up roller 12 to maintain the proper tension on wire 10 as it is unwound from the spool.

Wire 10 is then passed through soap and caustic wash tank 20 in a conventional manner to strip oil and oxides from the surface of the wire. Preferably, a trisodium phosphate or equivalent soap is preferred. The caustic is preferably a mild solution of sodium hydroxide with a concentration of about 5% or less. Further, the wash tank solution should be maintained at elevated temperatures on the order of 180° F. Wire 10 is then passed over a second tensioning take-up roller 31 before entering anodizing machine 40, which will be explained in greater detail hereinafter.

Upon exiting anodizing tank 40, wire 10 passes over roller 70 into a cold water rise tank 71 with the temperature preferably at about 60° and 70° F. Wire 10 then passes over a third tensioning take-up roller 72 into hot rinse tank 73 where the temperature is maintained at about 180° F. Rinse tanks 71 and 73 function to remove all acid from the anodized wire, and the hot water in tank 73 facilitates quick drying of the wire. Wire 10 is then passed over roller 74, through hot air dryer 75 and around rollers 76 and 77 and, optionally, into a conventional sealant coating unit 78. Although any conventional sealant is suitable, preferably a zylene thinned silicone sealer is preferred to seal the pores and to prevent corrosion and staining of the anodized wire. Infrared heaters 79 are provided in unit 78 to dry the coating, and an exhaust fan 80 is provided to remove resulting fumes. The sealed anodized wire 10 is then passed over a series of rollers 81 and another tensioning take-up roller 82 before it is wound onto spool 83 as a finished product.

Figure 2:
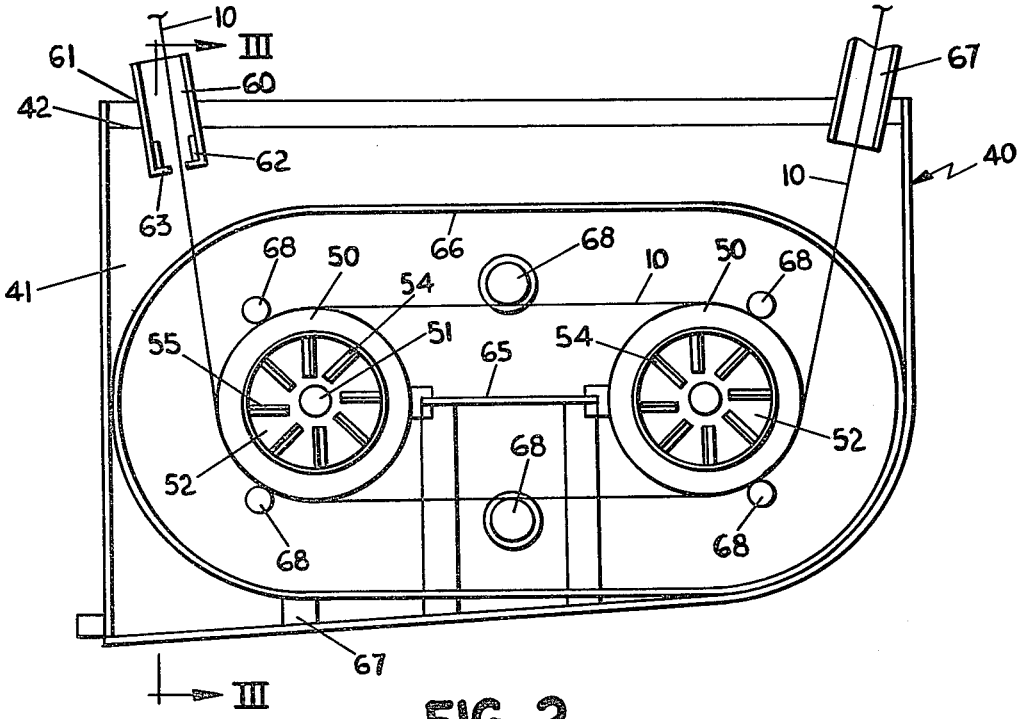
FIG. 2 is a side cross-sectional elevational view of the wire anodizing machine.
Figure 3:
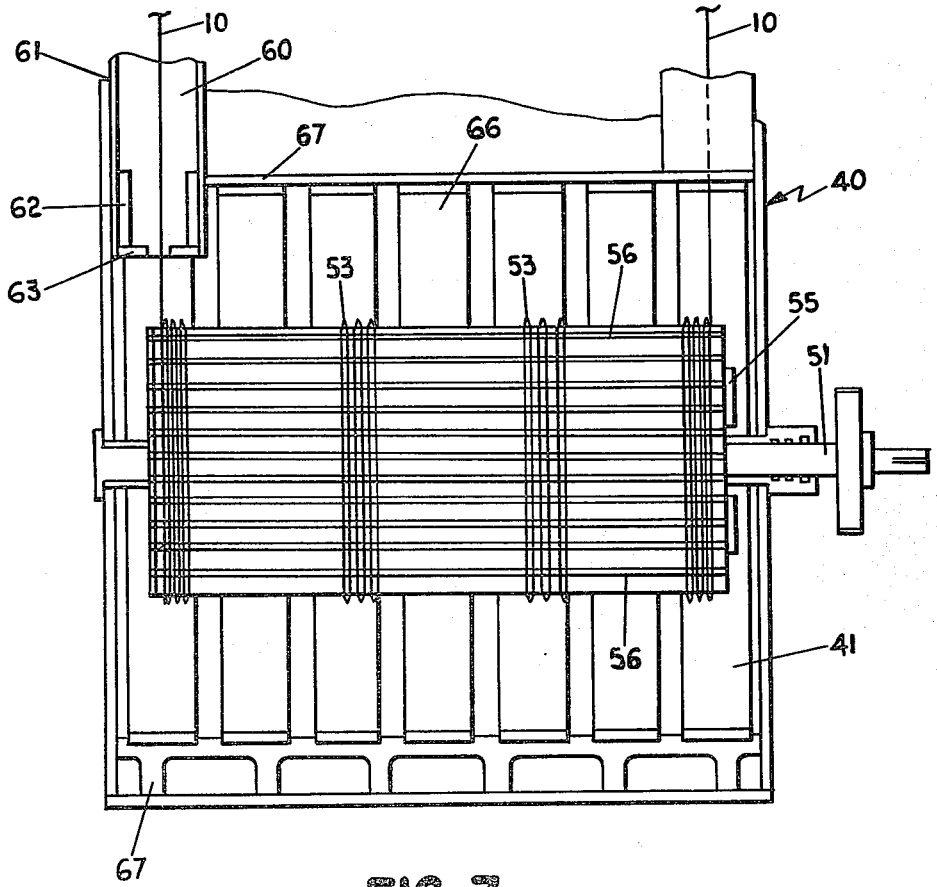
FIG. 3 is a cross-sectional elevational view of the anodizing machine taken along the line III—III of FIG. 2.

The unique anodizing machine 40 will now be described in greater detail. As shown in FIGS. 2 and 3, machine 40 includes anodizing tank 41 and a pair of adjacent rotatable wire accumulator drums 50. Tank 41 contains a conventional anodizing solution, which is typically an acid solution of an acid such as sulfuric, chromic or oxalic acid or the like. The preferred anodizing solution is about a 15 to 25% solution of sulfuric acid. The tank is filled with anodizing solution to solution level line 42 so that the accumulator drums 50 are submerged in solution.

The accumulator drums 50 are rotatably mounted in a conventional manner on axles 51 and are preferably motorized. When wire 10 is to follow the path shown in FIG. 2 between accumulator drums 50, both of drums 50 are rotatable in a counter-clockwise direction. However, to increase the retention time of wire 10 in tank 41, wire 10 can be made to traverse a figure eight pattern between drums 50 as shown in FIG. 1. In this case, the first drum is rotated in a clockwise direction and the second drum is rotated in a counter-clockwise direction.

The preferred accumulator drum 50 includes a pair of end hubs 52. The sidewalls of drum 50 are made of a plurality of spaced slanted support bars 56 attached to each of the hubs 52 and perpendicular thereto, the purpose of which will be explained below. A plurality of circumferential wire separators 53 are provided around support bars 56 as shown in FIG. 3. (Only a portion of the separators are shown in FIG. 3 to more clearly shown support bars 52).

Figure 4:
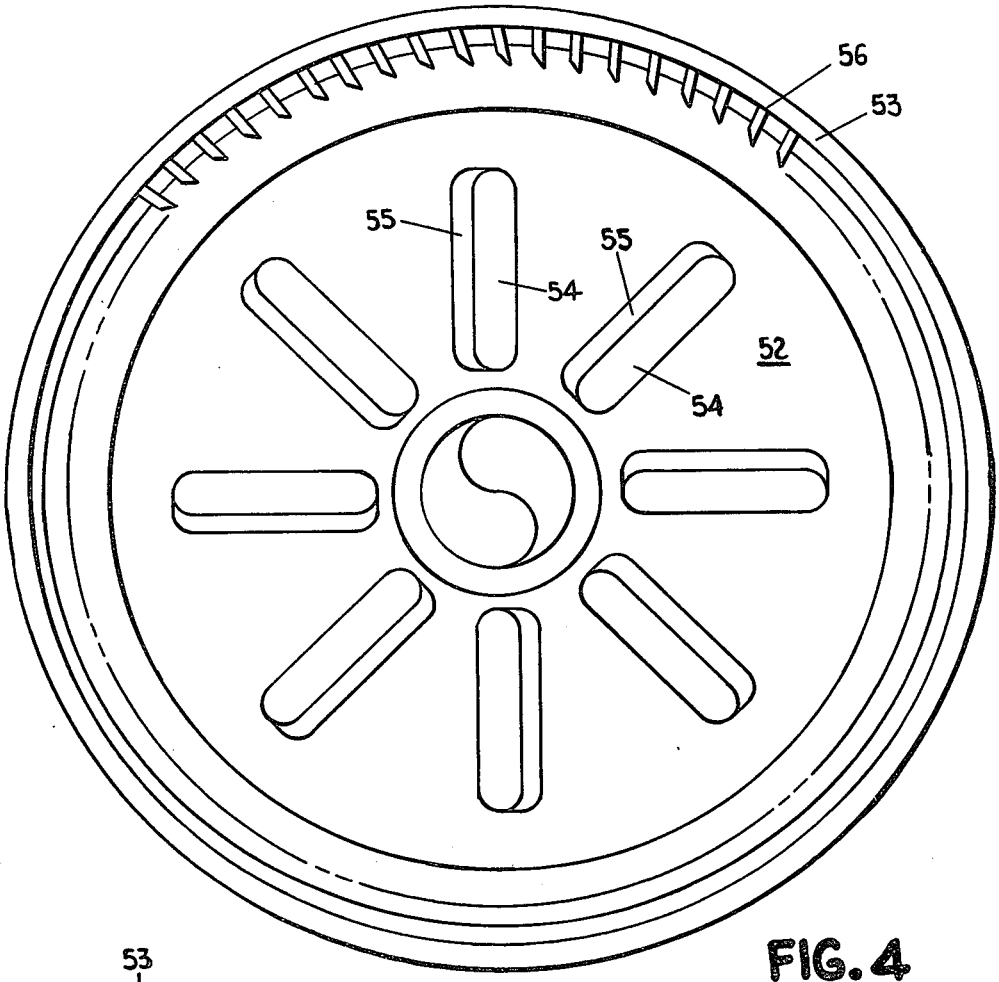
FIG. 4 is a cross-sectional view of a wire accumulator drum with a portion of the support bars shown.
Figure 7:
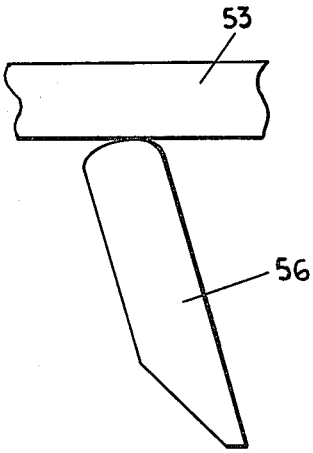
FIG. 7 is end view of an accumulator drum sidewall support bar and a portion of the wire separators.

In order to ensure uniform and complete coverage on wire 10, means are provided to produce a flow of anodizing electrolyte onto each of drums 50 through end hubs 52 and out of the space between support bars 56, passed wire separators 53. This is accomplished by providing a series of radial slots 54 on at least one of the end hubs 52 of each drum. External angled radial pumping vanes 55 are provided adjacent to each of slot 54. Thus, as drums 50 are rotated in the counter-clockwise direction, vanes 55 and slots 54 will act as an acid pump to draw acid into the interior of drums 50. Because of the spacing between support bars 56 and their configuration and mounting angle, as best shown in FIG. 4 and FIG. 7, the acid bath will be pumped out the sidewall of drums 50 and past wire separators 53. This pumping action serves two very important purposes. Not only does it ensure exposure of all surfaces of the wire to the anodizing fluid, it also acts to urge the wire away from touching wire separators 53 as best shown in FIG. 6. This greatly minimizes any contact between wire 10 and separators 53 or support bars 56 during anodizing to thereby avoid bare spots in the finished product.

Although a conventional anode and cathode arrangement may be utilized, it is preferred that a contact cell 60 be provided at wire ingress opening 61 to tank 41. Contact cell 60 is a fluid chamber which contains anodes 62 and an adjustable wire egress window 63. Any conventional adjustable window means can be employed for window 63 such as a sliding door, camera type shutter mechanism or the like. It has been found that if window opening 63 is adjusted to the point where bubbles appear on the wire surface, the optimum anodizing will take place. Optionally, the window can be also adjustable lengthwise to alter the distance between the anodes and the drums to optimize anodizing.

The preferred cathode means includes a center cathode 65, a series of cathode plates 66 surrounding both of drums 50, or both. Cathode plates 66 are suspended by insulated wood frame insulating members 76 in tank 41. It is especially important that cathode plates 66 be located above and below drums 60 adjacent the sidewalls of the drums. In the case of using the figure eight wire pattern shown in FIG. 1, the cathode 65 between drums 50 is eliminated.

Finally, a wire egress opening 67 is provided which leads to the rinse stage 70 of the anodizing process. In addition, a series of rollers 68 can be provided to guide wire 10 in its revolutions about drums 50.

Figure 5:
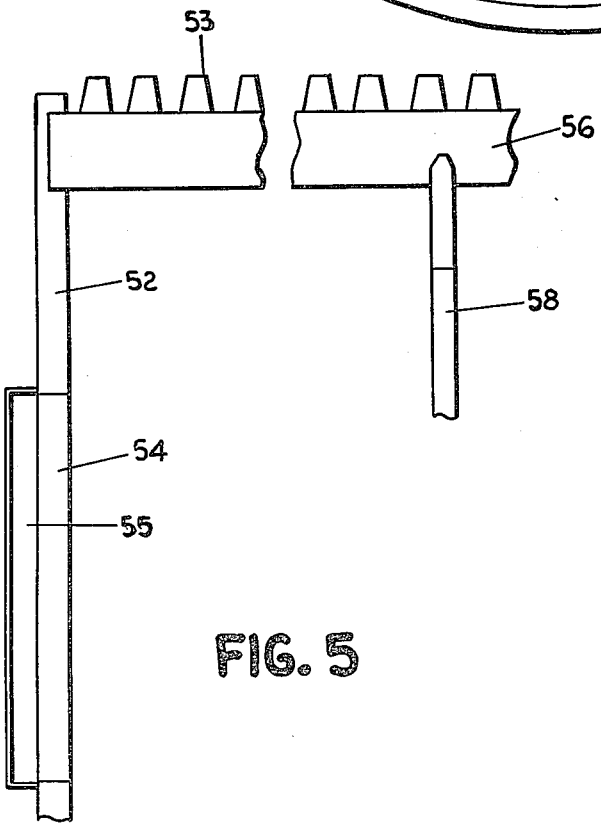
FIG. 5 is a fragmentary cross-sectional view of the accumulator drum.

While a variety of sizes of tanks and drums may be utilized, depending upon the particular size wire being anodized and the solutions used, it has been found that speeds in excess of 1,000 feet per minute of anodizing of the wire can be accomplished with a tank which is only about three feet deep, four feet long and four feet wide, with about one foot diameter accumulator drums approximately two feet long. For aluminum wire of approximately a 0.125 inch diameter, a retention time of about three to five minutes is required for optimum anodizing. Accordingly, with the above-described accumulator drums and tank size, the wire should be wrapped approximately 170 to 180 revolutions on each drum when running at a speed of approximately 1000 feet per minute. When larger drums are used, it may be required to use internal radial support members, such as member 58 shown partially in FIG. 5.

In terms of the electrical requirements, it has been found that between about 18 and 40 volts of DC current, with an amperage of approximately 60 to 75 amps per square foot of aluminum wire in the tank, is optimum.

While the preferred embodiments of the present invention have been described and illustrated, it will be obvious so those skilled in the art that various modifications and changes can be made without departing from the spirit of the present invention. As indicated, while the above disclosure has related to aluminum wire, aluminum strip stock and the like can also be processed according to the present invention. In addition, materials other than aluminum can be electroplated using the principles of the process and unique machine of the present invention. Accordingly, the scope of the present invention is deemed to be limited only by the appended claims when construed in terms of the equivalence discussed herein.

The embodiments of the invention in which an exclusive property or privilege is claimed are defined as follows:

1. A high speed aluminum wire anodizing machine comprising:

a wire anodizer tank having wire ingress and egress openings;

at least two adjacent rotatable wire accumulator drums in said tank with the axes of rotation of said drums in parallel alignment, said drums having means for urging the wire outwardly away from the outer surfaces of the drums so as to minimize contact between the wire and the drums and so as to cause the proximal surface of wire to be substantially in continuous contact with anodizing electrolyte while said wire encircles with drums;

an anode proximal to said wire ingress opening; and at least one cathode in said tank.

2. A high speed aluminum wire anodizing machine according to claim 1 wherein said drums are rotatable in the same direction and one cathode is positioned between said drums.

3. A high speed aluminum wire anodizing machine according to claim 1 which comprises a cathode above said drums and a cathode below said drums adjacent the sidewalls of said drums.

4. A high speed aluminum wire anodizing machine according to claim 3 wherein said drums are rotatable in opposite directions, with the wire passing in a figure eight pattern over the drums.

5. A high speed aluminum wire anodizing machine according to claim 3 wherein the cathode comprises a series of elongated conductive strips extending around the outer periphery of the drums in a general oval shape, with the strips being electrically interconnected and spaced apart along the longitudinal axes of the drums.

6. A high speed aluminum wire anodizing machine according to claim 1 wherein said anode is in a contact cell proximal to said wire ingress opening, said contact cell including a fluid chamber with the anode being mounted therein submerged in the electrolyte in anodizer tank and spaced from the wire, the fluid chamber having a wire window through which wire passes from said contact cell to said wire accumulator drums, the wire window being spaced from the wire to provide a predetermined amount of electrolyte liquid between the window and the wire, the cathode being proximal to the accumulator drums, the wire being continuously submerged in the electrolyte in the anodizer tank between the anode and cathode position.

7. A high speed aluminum wire anodizing machine according to claim 6 wherein the size of the wire window is adjustable to vary the amount of electrolyte liquid between the window and wire.

8. A high speed aluminum wire anodizing machine according to claim 1 wherein each of said accumulator drums is generally hollow and comprises a sidewall and an end hub on each end of the sidewall, at least one hub having an opening therein, the sidewall having a plurality of longitudinal slots therein, the means for urging the wire outwardly from the outer periphery of the drum comprising flow producing means for producing a flow of anodizing electrolyte into said drum through the opening in the end hub and out of the slots in the sidewall of said drum.

9. A high speed aluminum wire anodizing machine according to claim 8 wherein said flow producing means comprises at least one pumping vane means adjacent to said opening in said hub for urging electrolyte inwardly through the opening into the interior of the drum, the electrolyte thereby being urged outwardly through the slots in the sidewall.

10. A high speed aluminum wire anodizing machine according to claim 8 wherein the drum sidewall comprises a plurality of circumferentially arranged spaced support bars attached to and extending between the hubs, with the support bars being shaped and angles so as to urge electrolyte outwardly through the spaces between the bars as the drum is rotated, said support bars comprising at least one element of the flow producing means.

11. A high speed aluminum wire anodizing machine according to claim 8 and further comprising a plurality of wire separation means on the drum sidewalls for separating adjacent loops of wire encircling the drums.

12. A high speed aluminum wire anodizing machine according to claim 11 wherein the wire separation means comprise a plurality of circumferential ribs encircling the drum sidewalls, with the ribs being shaped and separated so as to provide downwardly and inwardly tapered grooves for the individual strands of wire on the drum.

13. The process for anodizing aluminum wire performed by the anodizing machine claimed in claim 1.

* * * * *

UNITED STATES PATENT AND TRADEMARK OFFICE

CERTIFICATE OF CORRECTION

PATENT NO. : 4,470,884

DATED : Sep. 11, 1984

INVENTOR(S) : Daniel N. Carr

It is certified that error appears in the above-identified patent and that said Letters Patent are hereby corrected as shown below:

Column 2, line 61, "60° and 70°" should be --60° to 70°--.

Column 3, line 44, "onto" should be --into--.

Column 4, line 14, "60" should be --50--.

Claim 1, Column 5, line 5, "with" should be --said--.

Claim 10, Column 6, line 25, "angles" should be --angled--.

Signed and Sealed this

*Thirtieth* Day of *April 1985*

[SEAL]

*Attest:*

DONALD J. QUIGG

*Attesting Officer* *Acting Commissioner of Patents and Trademarks*